United States Patent [19]

Hengstebeck

[11] 4,097,544

[45] Jun. 27, 1978

[54] SYSTEM FOR STEAM-CRACKING HYDROCARBONS AND TRANSFER-LINE EXCHANGER THEREFOR

[75] Inventor: Robert J. Hengstebeck, Valparaiso, Ind.

[73] Assignee: Standard Oil Company, Chicago, Ill.

[21] Appl. No.: 790,329

[22] Filed: Apr. 25, 1977

[51] Int. Cl.[2] ..... C07C 3/30; F28F 19/00

[52] U.S. Cl. ..... 260/683 R; 23/277 R; 23/284; 165/134; 196/138; 208/48 Q; 208/78; 208/79

[58] Field of Search ..... 260/683 R; 208/78, 79, 208/48 Q; 196/138; 165/134; 23/277 R, 284

[56] References Cited

U.S. PATENT DOCUMENTS

| | | | |
|---|---|---|---|
| 2,284,493 | 5/1942 | Noll et al. | 208/78 |
| 2,424,997 | 8/1947 | Newton | 208/79 |
| 3,015,619 | 1/1962 | Wimmer et al. | 260/48 Q |
| 3,132,691 | 5/1964 | Esleeck | 165/134 |
| 3,414,632 | 12/1968 | Buschmann et al. | 260/683 R |
| 3,416,598 | 12/1968 | Dorn | 208/48 R |
| 3,610,328 | 10/1971 | LaRue et al. | 208/48 R |

*Primary Examiner*—Delbert E. Gantz
*Assistant Examiner*—C. E. Spresser
*Attorney, Agent, or Firm*—Claron N. White; Arthur G. Gilkes; William T. McClain

[57] ABSTRACT

A system to produce ethylene includes, in one embodiment, separately cracking a heavy hydrocarbon feed and a lighter feed, cooling the latter product in a transfer-line exchanger before admixture with the former product and cooling the mixed product in a transfer-line exchanger. Both exchangers are preferably a novel transfer-line exchanger that has a construction including a vertical tank, with a cylindrical intermediate portion and conical bottom entrance and top exit end portions, tube sheets at the top and bottom ends of the intermediate portion of the tank, vertical tubes extending between the tube sheets and in alignment with openings in the tube sheets. The tubes extend downwardly through the lower tube sheet with their ends at openings in a conical shield that is supported in the entrance conical portion of the tank by the tubes or by the conical entrance portion of the tank. The lower tube sheet has an opening to pass steam into the chamber between that sheet and the shield or steam is introduced into that chamber through the wall of the conical entrance portion of the tank and through the shield. The construction provides egress of steam from this chamber to the entrance end of the tubes below the conical shield for mixture with product to be cooled. When using the novel transfer-line exchanger, the system can provide the cooling of the product from the steam-cracking of the heavier feed without prior admixture with cooled product from the steam-cracking of lighter feed.

17 Claims, 11 Drawing Figures

FIG. 8
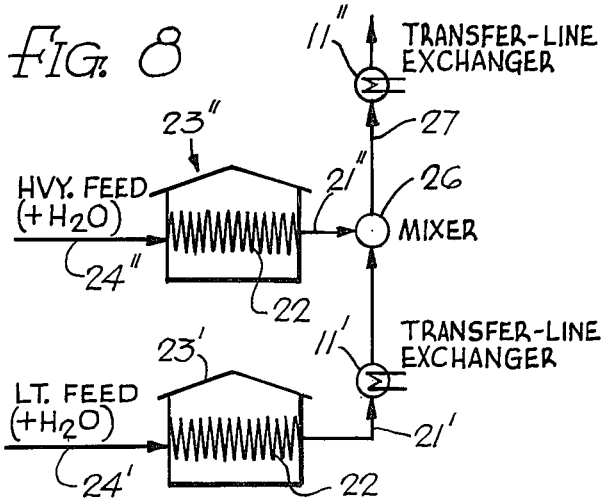
FIG. 1
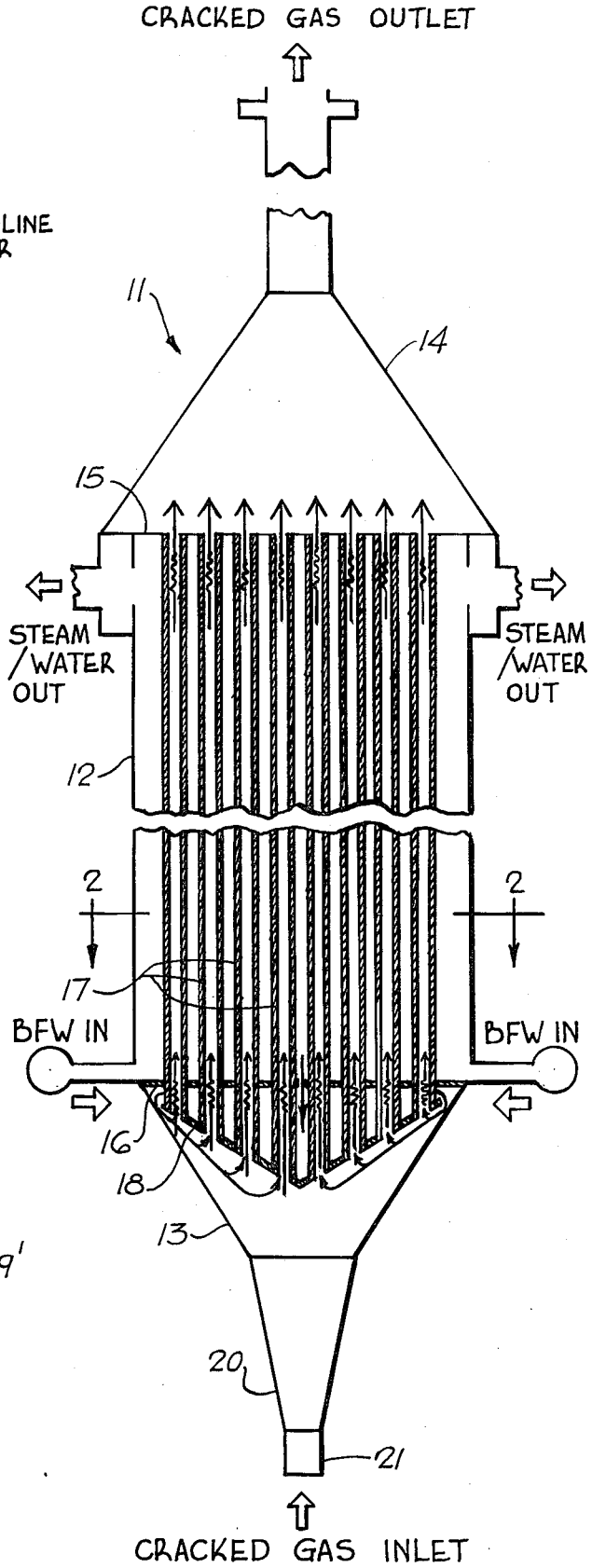
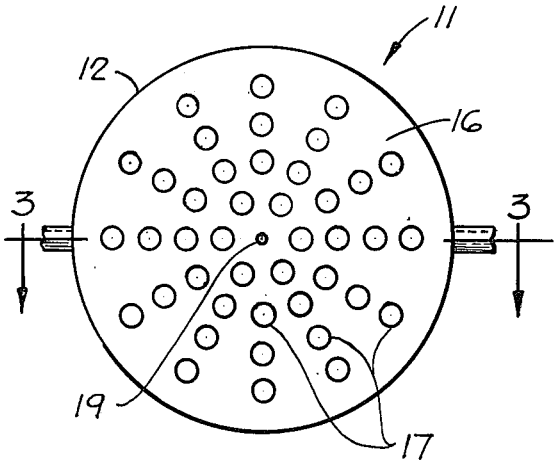
FIG. 2
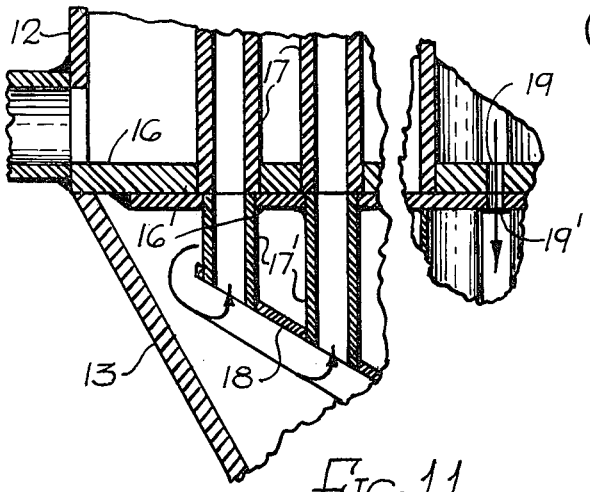
FIG. 11

FIG. 9
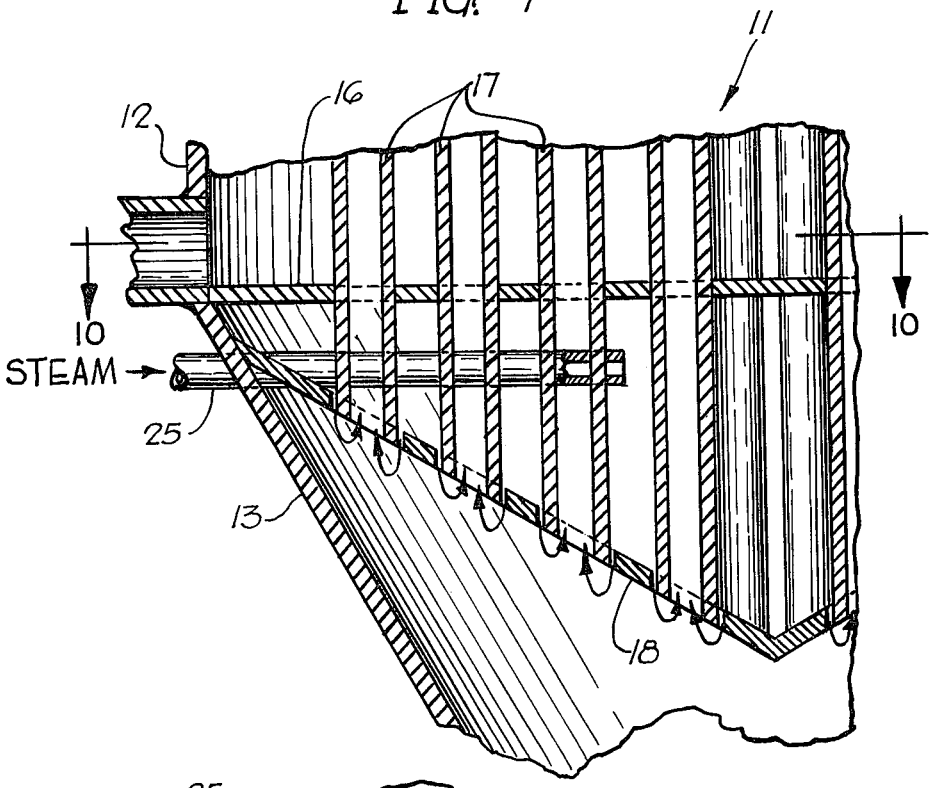
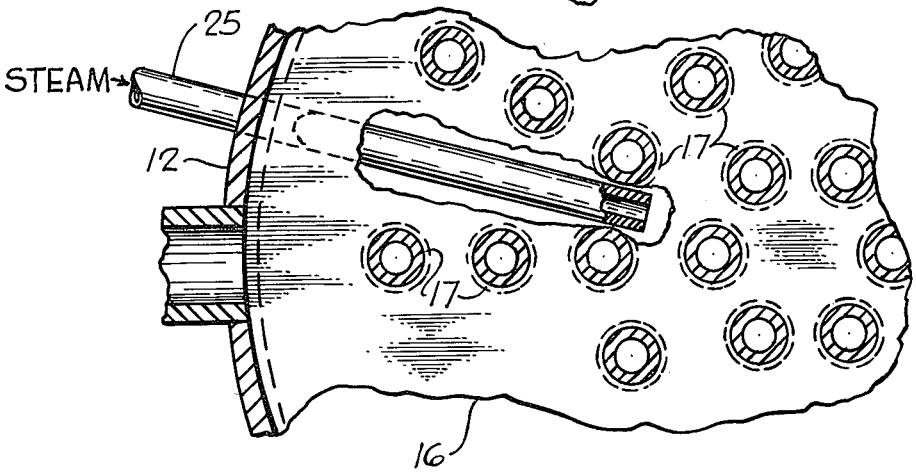
FIG. 10

SYSTEM FOR STEAM-CRACKING HYDROCARBONS AND TRANSFER-LINE EXCHANGER THEREFOR

BACKGROUND OF INFORMATION

1. Field of the Invention

This invention relates to a system of steam-cracking hydrocarbons to produce ethylene and more particularly relates to such system in which a heavy hydrocarbon feed, such as heavy naphtha or gas oil, is cracked at an elevated temperature in the presence of steam and the product is cooled using a transfer-line exchanger.

2. Description of the Prior Art

In the operation of a plant to make ethylene from a heavy hydrocarbon feed, the only practical solution for cooling the product has been a quenching of the product with either a relatively cold oil or steam. In the case of direct oil or steam quenching of the product, i.e., the effluent from the cracking furnace, this quenching is carried out to reduce the temperature of the inlet product gas so that coking will not occur at the inlet of a transfer-line exchanger in which the product is further cooled.

In the case of the system to produce ethylene by steam-cracking of lighter feeds, such as ethane or propane or their mixtures, it has been found possible by others to use a transfer line exchanger. That name has been used to designate heat exchangers that are located as close as possible to the outlet of the cracking furnace in order to minimize the time that the product gas is at a high temperature beyond the outlet of the cracking furnace and thereby minimize fouling problems, namely, coking at the inlet end of the tubes of the heat exchanger. Others have proposed a transfer-line heat exchanger that has the inlet tube sheet constructed in a stepped arrangement to extend into the conical entrance end portion of the exchanger. At that end the tubes in the exchanger are connected to this stepped tube sheet in alignment with the holes in the sheet. This construction reduces the volume of that part of the conical end portion into which the product gas flows before passage into the tubes of the exchanger. This reduces the residence time of the product gas between the outlet of the furnace and the cooling surfaces of the tubes of the exchanger. However, it is expensive to build a transfer-line exchanger with this structural arrangement, because the pressure within the chamber between the tube sheets of the exchanger are 600 to 1800 p.s.i.g.

SUMMARY OF THE INVENTION

The system of the present invention, as a process, includes a steam-cracking of a hydrocarbon feed at an elevated temperature to produce ethylene that is useful, for example, in the preparation of plastics. The hydrocarbon feed that is steam-cracked can be a heavy hydrocarbon feed, for example, heavy naphtha or gas oil, or can be a light hydrocarbon feed, such as ethane or propane or a feed containing these compounds. The gaseous product from the steam-cracking is passed through a transfer-line exchanger in which the product is passed through tubes for indirect heat exchange with water, that is at least partially converted to steam during its passage through the chamber of the tank of the exchanger in which the tubes are located.

In one embodiment of the process of the invention, a transfer-line exchanger having the construction of the prior art may be used. In this embodiment, the process separately steam-cracks a heavy hydrocarbon feed and a lighter hydrocarbon feed. The gaseous cracked product from the steam-cracking of the lighter hydrocarbon feed is cooled by passing it through tubes of a transfer-line exchanger that can have the construction of prior art transfer-line exchanger but preferably the cooling is provided by passage through the transfer-line exchanger of the present invention. In the process, this cooled gaseous cracked product from steam-cracking of lighter hydrocarbon feed is mixed with the gaseous cracked product from the steam-cracking of the heavier hydrocarbon feed and the mixture is cooled by passing it through a transfer-line exchanger that is preferably the transfer-line exchanger of the present invention. Of course, this embodiment of the process of the invention is possible when the ethylene plant is constructed with cracking furnaces for heavy and lighter hydrocarbon feeds.

In another embodiment of the process of the invention, that is useful in a plant in which only heavy hydrocarbon feed is steam-cracked, the process includes the steam-cracking of the heavy hydrocarbon feed and the cooling of the gaseous cracked product from the cracking operation by passing it through the transfer-line exchanger of the present invention that, because of its novel construction, provides the reduction of volume of the part of the conical entrance end portion into which gaseous cracked product flows before entering the tubes, as in the case of the prior design, mentioned above, that has the stepped inlet tube sheet. In addition to the reduced residence time of the gaseous cracked product in the part of the exchanger upstream of the cooling surfaces of the tubes of the transfer-line exchanger, the novel construction also provides mixing of steam with the gaseous cracked product adjacent to the entrance end of the tubes of the transfer-line exchanger. That steam for this admixture is provided from a chamber, that surrounds the entrance end portion of the tubes and that is below the main chamber of the exchanger into which water is introduced to be converted into steam by indirect heat exchange with the gaseous cracked product. This admixed steam functions as a part of or all, if desired, of the quenching steam to directly cool the gaseous cracked product before it enters the tubes. The admixture of steam and gaseous cracked product is indirectly cooled by steam as it passes upwardly in the tubes through the chamber below the main chamber and then indirectly cooled as it passes upwardly in the tubes through the main chamber, into which water, as mentioned above, is introduced and converted at least partially to steam. The steam in the chamber below the main chamber precludes the entrance of gaseous cracked product into that chamber. This combination of limited direct cooling with steam and subsequent steps of indirect heat exchange for cooling of gaseous cracked product minimizes formation of coke and thereby maintains an adequate indirect heat transfer. At the same time, this process provides a greater heat recovery, as steam, from the main indirect heat transfer. The process of this embodiment can be performed when lighter hydrocarbon feed is cracked. In that case, the transfer-line exchanger of the present invention is not required to be as close to the exit end of the cracking furnace to minimize coking as is the case for the cooling of gaseous cracked product lighter feed using a transfer-line exchanger of the prior art.

The system of the present invention, as apparatus, includes a furnace for steam-cracking a heavy hydrocarbon feed or a lighter hydrocarbon feed and further includes a transfer-line exchanger for cooling the gaseous cracked product from the furnace.

In one embodiment of the apparatus of the invention, there are two furnaces for steam-cracking of hydrocarbon feed. In one of them a heavy hydrocarbon feed is cracked and in the other the lighter hydrocarbon feed is cracked. This embodiment of the the apparatus includes two transfer-line exchangers and a mixer. The inlet of the first transfer-line exchanger is connected to the outlet of the furnace that is used to steam-crack lighter hydrocarbon feed. The outlet of the first transfer-line exchanger is connected to an inlet of the mixer to provide cooled gaseous cracked product from the exchanger to the mixer. Another inlet of the mixer is connected to the outlet of the furnace that is used to steam-crack heavy hydrocarbon feed. The outlet of the mixer is connected to the inlet of the second transfer-line exchanger. Because of this structural arrangement and the use of two furnaces, two transfer-line exchangers and a mixer, and because the cooled effluent from the furnace in which lighter hydrocarbon feed is cracked serves as a quenching material for the effluent from the furnace in which heavy hydrocarbon feed is cracked, it is possible to use a transfer-line exchanger of the prior art as the second transfer-line exchanger. The first transfer-line exchanger may also be a transfer-line exchanger of the prior art. However, preferably both transfer-line exchangers in this embodiment of the apparatus of the invention are exchangers of the present invention. This preferred construction will minimize fouling of the transfer-line exchanger by coke formation.

This embodiment of the system, as process or apparatus, of the invention differs from the prior art in which there is a quenching of gaseous cracked product by relatively cold oil. There are several differences. In the case of quenching with cold oil, it is necessary to separate it from its cooled admixture with the gaseous cracked product and it is necessary then to further cool the separated quenching oil before recycling it to the quenching operation. This separation and subsequent additional cooling are not required in this embodiment of the invention because one gaseous cracked product is used, after cooling, to provide a partial cooling of the other gaseous cracked product that is obtained by the steam-cracking of heavy hydrocarbon feed. This is because the gaseous cracked products from the steam-cracking of heavy and lighter hydrocarbon feeds have a similar composition, so that it is not necessary to provide any separation or recycle of quenching fluid. Accordingly, the overall cooling results in the production of more steam from the transfer-line exchanger and thus there is a maximizing of heat recovery.

In another embodiment of the apparatus of the invention there is a furnace for the steam-cracking of a heavy hydrocarbon feed or of a lighter hydrocarbon feed. The apparatus in this embodiment has the outlet of the furnace connected directly to the inlet of a transfer-line exchanger that is required to be the transfer-line exchanger of the present invention. Thus in the use of this embodiment of the apparatus of the invention, the gaseous cracked product from the steam-cracking of either hydrocarbon feed is passed directly to the transfer-line exchanger of the invention where the gaseous cracked product is mixed with steam flowing from a chamber surrounding the end portion of the tubes before the product enters the tubes of the exchanger. In the transfer-line exchanger the ends of the tubes extend to a position to minimize the residence time before the cracked gas product enters the tubes and the steam chamber reduces the space into which product flows before entering the tubes.

Another aspect of the invention is the novel transfer-line exchanger, which is several respects, has the same construction as that of a conventional transfer-line exchanger. As in the case of a conventional transfer-line exchanger, the transfer-line exchanger of the present invention includes a vertical tank having a cylindrical intermediate portion and conical bottom entrance and top exit end portions, tube sheets at the top and bottom ends of the intermediate portion of the tank, and vertical tubes extending between the tube sheets and in alignment with openings in the tube sheets. The tubes are connected to the top tube sheet so that the intermediate portion of the tank is a chamber that is closed at the top. As in the conventional construction the intermediate portion of the vertical tank is provided at the bottom part with an inlet for introduction of water normally called boiler feed water and at the top part of that intermediate portion of the tank there is an outlet for steam, as a mixture of steam and water, produced by indirect heat exchange with gaseous cracked product passing through the tubes of the exchanger. The main heat transfer of the gaseous cracked gas product occurs within the chamber of the intermediate portion of the tank in which the vertical tubes are located. This is an indirect heat transfer from the gaseous cracked product through the walls of the tubes to water, that is at least partially converted to steam in that chamber of the intermediate portion of the vertical tank. The transfer-line exchanger of the present invention differs from the conventional transfer-line exchanger in that the vertical tubes extend below the bottom tube sheet by different amounts so that the closer the tubes are to the vertical axis of the tank the greater the extension. The bottom ends of the tubes are beveled and terminated at positions such that the end surfaces of the tubes are aligned with a conical shield that is another component of the transfer-line exchanger of the invention. The conical shield has openings in alignment with the vertical tubes.

The major portion of the length of the tubes extends in a chamber between the top and bottom tube sheets that are at the ends of the intermediate portion of the tank. In the construction of the prior art this chamber is the only chamber for indirect heat exchange through the walls of the tubes that are connected to the tube sheets and in alignment with the holes in the tube sheets. Thus the tube sheets close the top and bottom of that chamber.

In the transfer-line exchanger of the present invention, a chamber is provided in the conical entrance end portion of the tank between the bottom tube sheet and the conical shield that is spaced below it, and within the conical entrance end portion of the tank. The tubes extend downwardly from the bottom tube sheet to the conical shield. This lower chamber is provided with steam for indirect heat exchange with a gas in the extensions of the tubes that are in this chamber, and from the chamber by virtue of the construction of the transfer-line exchanger of this invention, steam flows into that part of the conical entrance portion of the tank that is below the conical shield for admixture of steam and gaseous cracked product.

In one aspect of the construction of the transfer-line exchanger of the invention, the bottom tube sheet has at least one additional opening through which fluid, that includes steam, in the main chamber can pass downwardly into the chamber between that tube sheet and the conical shield. In an alternative construction the exchanger includes conduit means that passes through the wall of the conical entrance end portion of the tank and extends into the chamber between the bottom tube sheet and the conical shield to provide steam from a source other than the main chamber of the exchanger. In that construction it is not necessary to have the additional openings in the bottom tube sheet.

In one construction of the transfer-line exchanger of the invention, the conical shield is secured to and supported by the bottom end portion of the tubes. In that construction the periphery of the conical shield is spaced from the conical entrance end portion of the tank so that steam within the chamber between the conical shield and the bottom tube sheet can exit to the chamber between the shield and the conical entrance end portion of the tank and then flow downwardly and then radially inwardly below the shield. During this flow of the steam it admixes with gaseous cracked product introduced into the entrance end of the tank and the admixtures of steam and gaseous cracked product flows upwardly through the tubes.

In an alternative construction the conical shield is supported at its periphery by the conical entrance end portion of the tank. In that construction the size of the openings in the conical shield are greater than the outer diameter of the tubes so that there is a space between each tube and the sheet and through each of these annular spaces passes steam from the chamber between the conical shield and the bottom tube sheet. As in the construction in which the conical shield is secured to the bottom ends of the tubes, the space between the conical shield and the bottom tube sheet can be provided alternatively with steam through one or more additional openings in the tube sheet. As an alternative construction or in addition to the construction having the additional openings in the bottom tube sheet the conduit means, that passes through the wall of the conical entrance end portion of the tank, can be present to provide steam into the chamber between the conical shield and the bottom tube sheet.

DESCRIPTIONS OF THE DRAWINGS

FIG. 1 is a drawing partially schematic and partially as a vertical section, of one construction of the preferred embodiment of the transfer-line exchanger of the invention.

FIG. 2 is a horizontal section taken along the line 2—2 of FIG. 1 and showing illustratively the positions of the tubes of the transfer-line exchanger.

FIG. 3 is a fragmentary vertical section of the transfer-line exchanger taken along the line 3—3 of the FIG. 2 to show more clearly the opening in the bottom tube sheet for passage of steam and to show the construction in which the conical shield is supported by the end portions of the tubes.

FIG. 5 is an enlarged view of a portion of the exchanger as shown in FIG. 3.

FIG. 6 is a fragmentary view showing the alternative construction in which the conical shield is supported by the conical entrance end portion of the tank of the exchanger and has openings larger than the tubes for passage of steam downwardly to mix with gaseous cracked product before it flows upwardly through the tubes.

FIG. 7 is a sectional view taken along line 7—7 of FIG. 6.

Figure 4:
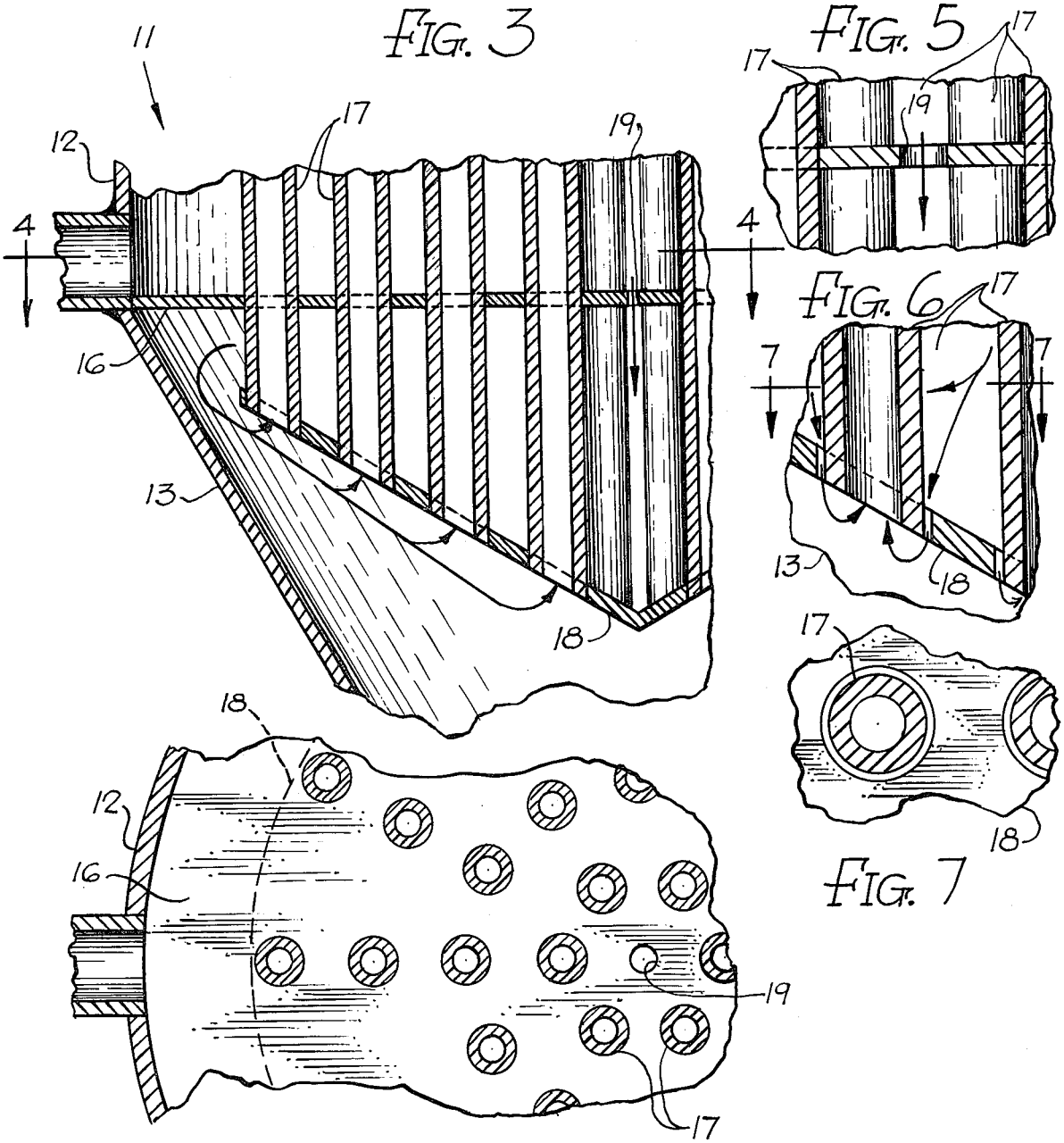
FIG. 4 is a sectional view taken along the line 4—4 of FIG. 3.

FIG. 8 is a schematic drawing of the apparatus of the invention in which there is separate steam-cracking of heavy hydrocarbon feed and lighter hydrocarbon feed, mixing their gaseous cracked products, after cooling the gaseous cracked product from the lighter feed by passage through a first transfer-line exchanger, and cooling of the admixed products by passage through a second transfer-line exchanger.

FIG. 9 is a fragmentary vertical section of the alternative construction of the embodiment of the heat exchanger in which the conical shield is supported by the conical entrance portion of the tank of the exchanger, showing the annular space between the tubes and the conical shield for steam passage and showing conduit means for introduction of steam through the wall of the conical entrance end portion of the tank to the chamber between the bottom tube sheet and the conical shield instead of introducing steam into that chamber through an opening in the bottom tube sheet.

FIG. 10 is a fragmentary view taken along line 10—10 of FIG. 9.

FIG. 11 is a fragmentary vertical section like that in FIG. 3 showing a modified construction.

DETAILED DESCRIPTION

A transfer-line exchanger of the invention is generally indicated at 11 in the various figures. Two transfer-line exchangers are shown in FIG. 8. They are identified as transfer-line exchangers 11' and 11'' because they may be transfer-line exchangers constructed in accordance with the prior art or may be transfer-line exchangers 11 that has the construction of the present invention and that construction is illustrated by transfer-line exchanger 11 shown in the other figures.

Referring to FIG. 1, transfer-line exchanger 11 includes a tank (not numbered), comprising a cylindrical intermediate portion 12, a conical entrance end portion 13 and a conical exit end portion 14. The exchanger 11 further includes, within the tank, top and bottom tube sheets 15 and 16, respectively, a number of vertical tubes 17, and a conical shield. The top and bottom tube sheets 15 and 16 are secured to at the top and bottom ends of intermediate portion 12 of the vertical tank and have a number of openings in alignment with vertical tubes 17. The top end of tubes 17 are secured to tube sheet 15. The tubes 17 are secured to tube sheet 16 and their bottom end portions extend through the openings of bottom tube sheet 16. The tubes 17 at their ends are beveled and the ends of these tubes support conical shield 18 so that shield 18 is spaced below bottom tube sheet 16. The shield 18 is located within conical entrance end portion 13 of the tank. The periphery of conical shield 18 is spaced from the wall of conical entrance end portion 13 of the tank to provide an annular passage between a chamber between conical shield 18 and bottom tube sheet 16 and the space in conical entrance end portion 13 below conical shield 18. This chamber between bottom tube sheet 16 and shield 18 communicates with the chamber within intermediate portion 12 of the tank by an opening 19 that is best seen in FIGS. 2–5.

The intermediate portion 12 of the tank adjacent its bottom end has a number of openings at which are connected pipes (not numbered) that are connected to an annular plenum that is connected by pipe (not shown) to a source of boiler feed water. Similarly the intermediate portion 12 of the tank adjacent its top end has a number of openings about its periphery for communication with an annular chamber (not numbered) that is connected to pipes (not numbered) that provide steam/water from exchanger 11 to other apparatus for utilization of the heat content in the steam/water.

The conical entrance end portion 13 of the tank is connected by a conical coupling 20 to a pipe 21 that is connected to the outlet end of pipe 22 (FIG. 8) in a steam-cracking furnace. In FIG. 8 two steam-cracking furnaces are shown and generally identified as furnace 23' and 23". The inlet end of pipes 22 in furnace 23' and in furnace 23" are connected to supply pipes 24' and supply pipe 24", respectively.

As seen in FIG. 3, shield 18 is secured to the bottom end portions of the downward extensions of tubes 17 that are secured in vertical position by tube sheets 15 and 16. The upward flow of the gaseous cracked product from a steam-cracking furnace, either furnace 23' or furnace 23", into conical entrance end portion 13 and the upward flow through tubes 17 is indicated in FIG. 1. The downward flow of aqueous fluid containing steam through opening 19 into the chamber between bottom tube sheet 16 and conical shield 18 is best shown in FIGS. 3 and 5. The flow from that chamber of the steam-containing aqueous fluid toward the top part of the wall of conical entrance end portion 13 of the tank and then downwardly for admixture with the gaseous cracked product and the upward flow of the mixture into tubes 17 is shown in FIGS. 1 and 3.

The alternative construction in which conical shield 18 is supported at its periphery by securing it to the upper part of the wall of conical entrance end portion 13 of the tank is shown in FIG. 9. In that construction tubes 17 are supported by top and bottom tube sheets 15 and the openings in shield 18 are larger than the outer diameter of tubes 17. This provides an annular passage (FIGS. 6, 7, 9 and 10) between the end portions of tubes 17 and shield 18 through which steam passes downwardly from the chamber between bottom tube sheet 16 and conical shield 18. This steam from the chamber mixes with gaseous cracked product passing upwardly through conical entrance end portion 13 and the mixture passes upwardly through tubes 17. The steam in this chamber is provided, in this embodiment, by a horizontal pipe 25 that extends through the upper part of the wall of conical entrance end portion 13 of the tank and into the chamber between bottom tube sheet 16 and conical shield 18. The pipe 25 is connected to a steam source (not shown). In this illustrative bottom tube sheet 16 does not have opening 19 to transfer steam as steam-containing fluid from the chamber in intermediate portion 12 of the tank to that chamber between bottom tube sheet 16 and conical shield 18. Of course, opening 19 could be present but it is not necessary. In FIG. 9, pipe 25 extends through shield 18 only because the upper margin of shield 18 is at and above that elevation. The shield 18 can be modified to be entirely below pipe 25 that can extend alternatively through the wall of portion 12 and then downwardly through tube sheet 16.

Referring to FIG. 8 the pipe 24" is provided with a mixture of heavy hydrocarbon feed and water that is passed through pipe 22 of furnace 23". Similarly the lighter hydrocarbon feed as a mixture with water is transferred by pipe 24' to pipe 22 in furnace 23'. The outlet of pipe 22 in furnace 23' is connected by a pipe 21' to the entrance end portion of transfer-line exchanger 11' that has its exit end portion connected by a line (not numbered) to one inlet of a mixer 26. Another inlet of mixer 26 is connected by pipe 21" to pipe 22 of furnace 23". The outlet of mixer 26 is connected by a pipe 27 to the entrance end portion of transfer-line exchanger 11" and the exit end portion of that exchanger is connected by a pipe (not numbered) to apparatus (not shown) in which the cooled mixture of gaseous cracked products from furnaces 23' and 23" is processed for the recovery of ethylene.

In order to withstand the high pressure in the cylindrical intermediate portion 12 of the tank of the exchanger, it is necessary to use thick-walled vertical tubes 17. In the embodiments shown in FIGS. 1–7, 9 and 10 thick-walled tubes 17 extend downwardly through bottom tube sheet 16 to conical shield 18. This extension of tubes 17 is not subjected to that high pressure. Furthermore, it would be difficult to fabricate the assembly of tubes 17 secured to top tube sheet 15, bottom tube sheet 16 and conical shield 18. That assembly is in the embodiment shown in FIGS. 1-7. To provide an easier and less expensive method of assembly, tubes 17 extend downwardly only to bottom tube sheet 16. A subassembly of a thinner tube sheet 16', thinner-walled short tubes 17' and conical shield 18 is fabricated. The tubes 17' have the same inner diameter as tubes 17. The sheet 16' has an opening 19' with the same size as and in alignment with opening 19 in bottom tube sheet 16. The subassembly is placed below bottom tube sheet 16 and secured to its bottom face is the top face of tube sheet 16'. This construction is shown in FIG. 11. That is a fragmentary view, like FIG. 3, of the modified construction.

In the foregoing descriptions of the transfer-line exchanger of the invention and of its use in the system, as apparatus or process, of the invention, the exchanger has been described with the conical entrance end portion below and the conical top exit end portion above the cylindrical intermediate portion of the vertical tank. This reference to "top", and "bottom", "above" and "below" is for reference purpose. The exchanger can be inverted for its use. In that case the conical entrance end portion is a conical top entrance end portion while the conical exit end portion is a conical bottom exit end portion and the conical shield would be in the conical entrance end portion and its vertex would be above its base. When thus used, the side openings of intermediate portion adjacent the then top and bottom ends would be used to withdraw and introduce, respectively, fluid coolant.

The foregoing description has been presented solely for the purpose of illustration and not by way of limitation of the invention because the latter is limited only by the claims that follow.

I claim:

1. A transfer-line exchanger, useful in a system for steam-cracking hydrocarbons to produce ethylene, which comprises:

a vertical tank having:

a cylindrical intermediate portion with side openings adjacent the top and bottom ends to withdraw and introduce, respectively, fluid coolant;

a conical bottom entrance end portion connected to the bottom end of said intermediate portion; and a conical top exit end portion connected to the top end of said intermediate portion;

a horizontal top tube sheet having a number of openings and supported by said tank at the top end of said intermediate portion of said tank;

a horizontal bottom tube sheet having a number of openings corresponding to and in vertical alignment with said openings in said top tube sheet, said bottom tube sheet being supported in said tank at the bottom end of said intermediate portion of said tank;

a conical shield having its vertex below its base and supported within said conical bottom entrance end portion of said tank to provide an upper chamber between said shield and said bottom tube sheet and a lower chamber between said shield and the bottom part of said conical bottom entrance end portion, said shield having openings in vertical alignment with said openings in said tube sheets;

a number of vertical tubes in said openings of said top tube sheet and extending through said bottom tube sheet to said openings in said conical shield; and means to introduce steam into the chamber between said conical shield and said bottom tube sheet, said conical shield being constructed with respect to said tubes or said conical bottom entrance end portion so that steam introduced into said upper chamber between said conical shield and said bottom tube sheet can pass downwardly into said lower chamber in said conical bottom entrance end portion to mix with gas passing upwardly through said conical bottom entrance end portion of said tank before the gas passes upwardly through said tubes.

2. The exchanger of claim 1 wherein:

said conical shield has the diameter of its base such that the periphery of said shield is spaced from said conical bottom entrance end portion of said tank to provide an annular space for said passage of steam outwardly and then downwardly from said upper chamber above said conical shield to said lower chamber below said conical shield to mix with the upflowing gas; and said means to introduce steam into the chamber between said conical shield and said bottom tube sheet is provided by at least one additional opening in said bottom tube sheet.

3. The exchanger of claim 2 wherein said conical shield is supported by said tubes and said tubes close said openings in said conical shield.

4. The exchanger of claim 1 wherein:

said conical shield is supported by and has its base extending to the upper part of said conical entrance end portion of said tank;

said openings in said conical shield are larger in diameter than said tubes to provide annular spaces for said passage of the steam downwardly to said lower chamber below said conical shield to mix with the upflowing gas; and said means to introduce steam includes a pipe extending into said tank to said chamber between said conical shield and said bottom tube sheet.

5. A system for cooling a gaseous product, containing ethylene, obtained directly from the steam-cracking of hydrocarbons at an elevated temperature, which comprises:

passing said gaseous product upwardly and divergingly through the lower chamber of a bottom zone having an upper chamber and the lower chamber, each chamber having an upwardly diverging bottom wall with conical configuration;

passing the gaseous product upwardly from the lower chamber of the bottom zone as separate vertical streams through the upper chamber of the bottom zone in indirect heat exchange relationship with steam and then upwardly through a longer intermediate zone in indirect heat exchange relationship with an aqueous fluid coolant;

combining the streams of gaseous product in a top zone having an upwardly converging top wall;

removing the combined gaseous product from the top zone;

passing the aqueous fluid coolant upwardly through the intermediate zone for the indirect heat exchange relationship with the gaseous product streams passing upwardly through that zone;

providing steam into the upper chamber of the bottom zone for the indirect heat exchange relationship with the gaseous product streams passing upwardly through the chamber; and passing steam from the upper chamber of the bottom zone downwardly into the lower chamber of the bottom zone for admixture with the gaseous product introduced into the bottom zone and for passage of the steam upwardly with the streams of the gaseous product through the upper chamber of the bottom zone and the intermediate zone in indirect heat exchange relationship with steam and aqueous fluid coolant, respectively.

6. The system of claim 5 in which the steam, that is provided to the upper chamber of the bottom zone, is provided from the intermediate zone.

7. The system of claim 6 wherein the steam from the upper chamber of the bottom zone is passed to the lower chamber of the bottom zone after first moving horizontally and outwardly and then in passed inwardly in the lower chamber of the bottom zone while it is passing downwardly in the lower chamber.

8. The system of claim 5 in which the steam in the upper chamber of the bottom zone is provided from a source of steam other than from the intermediate zone.

9. The system of claim 8 wherein the steam in the upper chamber of the bottom zone passes downwardly from the upper chamber into the bottom chamber of the bottom zone as annular streams surrounding the separate streams of upwardly flowing mixture of gaseous product and steam.

10. A system, as an apparatus, for steam-cracking hydrocarbons to produce a gaseous steam-cracked product containing ethylene, which comprises:

a first furnace for steam-cracking a heavy hydrocarbon feed, said first cracking furnace having a pipe with an inlet for entrance of the heavy hydrocarbon feed with water and an outlet for gaseous cracked product;

a second furnace for steam-cracking a lighter hydrocarbon feed, said second cracking furnace having a pipe with an inlet for entrance of the lighter hydrocarbon feed with water and an outlet for gaseous cracked product;

a mixer having first inlet, a second inlet and an outlet, said first inlet being connected to said outlet of said pipe of said first furnace;

a first transfer-line exchanger having an outlet connected to said second inlet of said mixer and an inlet connected to said outlet of said pipe of said second furnace; and a second transfer-line exchanger having an inlet connected to said outlet of said mixer, whereby, in the use of the apparatus, the gaseous cracked product from the lighter hydrocarbon feed is cooled by passage through said first transfer-line exchanger and then mixed with the gaseous cracked product from the heavy hydrocarbon feed before that product from the heavy hydrocarbon feed is passed through the second transfer-line exchanger.

11. The system of claim 10 in which at least one said first and second transfer-line exchangers comprises:

a vertical tank having:

a cylindrical intermediate portion with side openings adjacent the top and bottom ends to withdraw and introduce, respectively, fluid coolant;

a conical bottom entrance end portion connected to the bottom end of said intermediate portion; and a conical top exit end portion connected to the top end of said intermediate portion;

a horizontal top tube sheet having a number of openings and supported by said tank at the top end of said intermediate portion of said tank;

a horizontal bottom tube sheet having a number of openings corresponding to and in vertical alignment with said openings in said top tube sheet, said bottom tube sheet being supported in said tank at the bottom end of said intermediate portion of said tank;

a conical shield having its vertex below its base and supported within said conical bottom entrance end portion of said tank to provide an upper chamber between said shield and said bottom tube sheet and a lower chamber between said shield and the bottom part of said conical bottom entrance end portion, said shield having openings in vertical alignment with said openings in said tube sheets;

a number of vertical tubes in said openings of said top tube sheet and extending through said bottom tube sheet to said openings in said conical shield; and means to introduce steam into the chamber between said conical shield and said bottom tube sheet, said conical shield being constructed with respect to said tubes or said conical bottom entrance end portion so that steam introduced into said upper chamber between said conical shield and said bottom tube sheet can pass downwardly into said lower chamber in said conical bottom entrance end portion to mix with the gaseous cracked product passing upwardly through said conical bottom entrance end portion of said tank before the gaseous cracked product passes upwardly through said tubes.

12. The system of claim 11 wherein for said at least one of said transfer-line exchangers:

said conical shield has the diameter of its base such that the periphery of said shield is spaced from said conical bottom entrance end portion of said tank to provide an annular space for said passage of steam outwardly and then downwardly from said upper chamber above said conical shield to said lower chamber below said conical shield to mix with the upflowing gaseous cracked product; and said means to introduce steam into the chamber between said conical shield and said bottom tube sheet is provided by at least one additional opening in said bottom tube sheet.

13. The system of claim 12 wherein said conical shield is supported by said tubes and said tubes close said openings in said conical shield.

14. The system of claim 11 wherein for said at least one of said transfer-line exchangers:

said conical shield is supported by and has its base extending to the upper part of said conical entrance end portion of said tank;

said openings in said conical shield are larger in diameter than said tubes to provide annular spaces for said passage of the steam downwardly to said lower chamber below said conical shield to mix with the upflowing gaseous product; and said means to introduce steam includes a pipe extending into said tank to said chamber between said conical shield and said bottom tube sheet.

15. A system, as a process, for steam-cracking hydrocarbons to produce a gaseous steam-cracked product containing ethylene, which comprises:

steam-cracking a heavy hydrocarbon feed at an elevated temperature to produce a first gaseous steam-cracked product containing ethylene;

separately steam-cracking a lighter hydrocarbon at an elevated temperature to pro-uce a second gaseous steam-cracked product containing ethylene;

cooling the second gaseous steam-cracked product by passing it through a transfer-line exchanger in indirect heat exchange relationship with an aqueous fluid coolant;

mixing the cooled second gaseous steam-cracked product with the first gaseous steam-cracked product; and passing the mixture through a second transfer-line exchanger for indirect heat exchange relationship with aqueous fluid coolant.

16. The system of claim 15 wherein the cooling of at least one of the second gaseous steam-cracked product and the mixture of the first gaseous steam-cracked product and the cooled second gaseous steam-cracked product, as a gaseous product, is provided by:

passing said gaseous product upwardly and divergingly through the lower chamber of a bottom zone having an upper chamber and the lower chamber, each chamber having an upwardly diverging bottom wall with conical configuration;

passing the gaseous product upwardly from the lower chamber of the bottom zone as separate vertical steams through the upper chamber of the bottom zone in indirect heat exchange relationship with steam and then upwardly through a longer intermediate zone in indirect heat exchange relationship with an aqueous fluid coolant;

combining the stream of gaseous product in a top zone having an upwardly converging top wall;

removing the combined gaseous product from the top zone;

passing the aqueous fluid coolant upwardly through the intermediate zone for the indirect heat exchange relationship with the gaseous product streams passing upwardly through that zone;

providing steam into the upper chamber of the bottom zone for the indirect heat exchange relationship with the aqueous product streams passing upwardly through that chamber; and passing steam from the upper chamber of the bottom zone downwardly into the lower chamber of the bottom zone for admixture with the gaseous product introduced into the bottom zone and for passage of the steam upwardly with the streams of the gaseous product through the upper chamber of the bottom zone and the intermediate zone in indirect heat exchange relationship with steam and aqueous fluid coolant, respectively.

17. A transfer-line exchanger, useful in a system for steam-cracking hydrocarbons to produce ethylene, which comprises:

a vertical tank having:

a cylindrical intermediate portion with side openings adjacent the top and bottom ends to withdraw and introduce, respectively, fluid coolant;

a conical bottom entrance end portion connected to the bottom end of said intermediate portion; and a conical top exit end portion connected to the top end of said intermediate portion;

a horizontal top tube sheet having a number of openings and supported by said tank at the top end of said intermediate portion of said tank;

a horizontal bottom tube sheet having a number of openings corresponding to and in vertical alignment with said openings in said top tube sheet and an additional opening, said bottom tube sheet being supported in said tank at the bottom end of said intermediate portion of said tank;

a horizontal sheet below and thinner than said horizontal bottom tube sheet and having a number of smaller openings corresponding to and in vertical alignment with said number of openings in said bottom tube sheet and having an additional opening corresponding in size and in vertical alignment with said additional opening in said bottom tube sheet;

a conical shield having its vertex below its base and supported within said conical bottom entrance end portion of said tank to provide an upper chamber between said shield and said horizontal thinner sheet and a lower chamber between said shield and the bottom part of said conical bottom entrance end portion, said conical shield having a number of openings corresponding in size and number to and in vertical alignment with said number of smaller openings in said horizontal thinner sheet and said conical shield has the diameter of its base such that the periphery of said shield is spaced from said conical bottom entrance end portion of said tank to provide an annular space communicating said upper chamber above said conical shield with said lower chamber below said conical shield;

a number of first vertical tubes corresponding in number to the said number of openings in said horizontal top and bottom tube sheets, said number of first vertical tubes extending into and between and being supported by said top and bottom tube sheets and said first vertical tubes closing said number of openings in said top and bottom tube sheets; and a number of second vertical tubes having thinner walls than said first vertical tubes and having the same inner diameter as that of said first vertical tubes, said second vertical tubes extending into said number of smaller openings in said thinner horizontal sheet and into said number of openings of said conical shield, said horizontal thinner sheet, said second vertical tubes and said conical shield being a subassembly supported in position with said horizontal thinner horizontal sheet abutting said horizontal bottom tube sheet.

* * * * *

UNITED STATES PATENT AND TRADEMARK OFFICE

CERTIFICATE OF CORRECTION

PATENT NO. : 4,097,544

DATED : June 27, 1978

INVENTOR(S) : Robert J. Hengstebeck

It is certified that error appears in the above-identified patent and that said Letters Patent are hereby corrected as shown below:

Column 4, line 7, "is" should read --in--.
Column 5, line 32, "each tube and the sheet" should read --each tube and the shield--.
Column 7, line 52, "illustrative" should read --illustration--.
Column 12, line 30, "pro-uce" should read --produce--.
Column 13, line 1, "aqueous" should read --gaseous--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*